US006676614B1

(12) United States Patent
Hansen et al.

(10) Patent No.: US 6,676,614 B1
(45) Date of Patent: Jan. 13, 2004

(54) VEST FOR BODY PULSATING METHOD AND APPARATUS

(75) Inventors: Craig N. Hansen, Plymouth, MN (US); Lonnie J. Helgeson, New Prague, MN (US)

(73) Assignee: Electromed, Inc., New Prague, MN (US)

( * ) Notice: Subject to any disclaimer, the term of this patent is extended or adjusted under 35 U.S.C. 154(b) by 183 days.

(21) Appl. No.: 09/902,471

(22) Filed: Jul. 10, 2001

Related U.S. Application Data

(60) Provisional application No. 60/217,367, filed on Jul. 11, 2000.

(51) Int. Cl.[7] ..... A61H 31/00
(52) U.S. Cl. ..... 601/41; 601/44
(58) Field of Search ..... 601/41–44, 148–152; 128/DIG. 20; 602/13

(56) References Cited

U.S. PATENT DOCUMENTS

| | | | |
|---|---|---|---|
| 2,223,570 | A | 12/1940 | McMillin |
| 2,354,397 | A | 7/1944 | Miller |
| 2,588,192 | A | 3/1952 | Akerman et al. |
| 2,762,366 | A | 9/1956 | Huxley, III et al. |
| 2,780,222 | A | 2/1957 | Polzin et al. |
| 2,869,537 | A | 1/1959 | Chu |
| 2,899,955 | A | 8/1959 | Huxley, III et al. |
| 3,043,292 | A | 7/1962 | Mendelson |
| 3,063,444 | A | 11/1962 | Jobst |
| 3,078,842 | A | 2/1963 | Gray |
| 3,179,106 | A | 4/1965 | Meredith |
| 3,310,050 | A | 3/1967 | Goldfarb |
| 3,545,017 | A | 12/1970 | Cohn |

(List continued on next page.)

FOREIGN PATENT DOCUMENTS

CA 1225889 8/1987

OTHER PUBLICATIONS

"Preliminary Evaluation of High–Frequency Chest Compression for Secretion Clearance in Mechanically Ventilated Patients," Respiratory Care, Oct. 1993.
"Artificial Ventilation," 1986.
"Tracheal mucus clearance in high–frequency oscillation: effect of peak flow rate bias," The European Respiratory Journa, Jan. 1990.
"High–frequency Chest Compression System to Aid in Clearance of Mucus from the Lung," Biomedical Instrumentation & Technology, Jul. 1990.
"Chronic bronchial asthma and emphysema," Geriatrics, Jun. 1966.
"Enhanced Tracheal Mucus Clearance with High Frequency Chest Wall Compression," American Review of Respiratory Disease, Sep. 1983.
"Peripheral mucociliary clearance with high–frequency chst wall compression," Journal of Applied Physiology, Apr. 1985.

*Primary Examiner*—Danton D. DeMille

(57) ABSTRACT

A vest for a human body has an air core coupled to a pulsator operable to subject the vest to repeated pulses of air which applies and releases pressure to the body. The vest has a cover having a pocket accommodating the air core, shoulder straps, and end flaps. Releasable hook and loop fasteners connect the straps to chest portions of the vest and end flaps to each other. A releasable retainer secured to the end flaps prevent the end flaps and releasable fasteners from disengaging when air pressure pulses are applied to the vest. The air core has an air chamber and a sleeve having an air receiving passage and openings to allow air to flow from the air receiving passage into the air chamber. A coil spring within the sleeve maintains the air receiving passage open.

34 Claims, 10 Drawing Sheets

U.S. PATENT DOCUMENTS 3,577,977 A 5/1971 Ritzinger, Jr. et al.
4,120,297 A * 10/1978 Rabischong et al. . 128/DIG. 20
4,135,503 A * 1/1979 Romano ..... 602/13
4,178,922 A 12/1979 Curlee
4,186,732 A 2/1980 Christoffel
4,375,217 A * 3/1983 Arkans ..... 601/152
4,402,312 A * 9/1983 Villari et al. ..... 601/152
4,590,925 A 5/1986 Dillon
4,621,621 A 11/1986 Marsalis
4,676,232 A 6/1987 Olsson et al.
4,682,588 A 7/1987 Curlee
4,838,263 A 6/1989 Warwick et al.
4,840,167 A 6/1989 Olsson et al.
4,952,095 A 8/1990 Walters
4,977,889 A 12/1990 Budd
5,007,412 A 4/1991 DeWall
5,056,505 A 10/1991 Warwick et al.
5,222,478 A 6/1993 Scarberry et al.
5,235,967 A 8/1993 Arbisi et al.
5,370,603 A 12/1994 Newman
5,453,081 A 9/1995 Hansen
5,569,170 A 10/1996 Hansen
D379,396 S 5/1997 Rongo et al.
5,769,800 A 6/1998 Gelfand et al.
5,938,627 A * 8/1999 Hickman ..... 601/149
6,036,662 A 3/2000 Van Brunt et al.
6,155,996 A 12/2000 Van Brunt et al.
6,254,556 B1 * 7/2001 Hansen et al. ..... 601/149

* cited by examiner

VEST FOR BODY PULSATING METHOD AND APPARATUS

CROSS REFERENCE TO RELATED APPLICATION

This application claims the benefit of U.S. Provisional Application Serial No. 60/217,367 filed Jul. 11, 2000.

FIELD OF THE INVENTION

The invention is directed to a medical device and method to apply repetitive compression forces to the body of a person to aid blood circulation, loosening and elimination of mucus from the lungs of a person and relieve muscular and nerve tensions.

BACKGROUND OF THE INVENTION

Clearance of mucus from the respiratory tract in healthy individuals is accomplished primarily by the body's normal mucociliary action and cough. Under normal conditions these mechanisms are very efficient. Impairment of the normal mucociliary transport system or hypersecretion of respiratory mucus results in an accumulation of mucus and debris in the lungs and can cause severe medical complications such as hypoxemia, hypercapnia, chronic bronchitis and pneumonia. These complications can result in a diminished quality of life or even become a cause of death. Abnormal respiratory mucus clearance is a manifestation of many medical conditions such as pertussis, cystic fibrosis, atelectasis, bronchiectasis, cavitating lung disease, vitamin A deficiency, chronic obstructive pulmonary disease, asthma, and immotile cilia syndrome. Exposure to cigarette smoke, air pollutants and viral infections also adversely affect mucociliary function. Post surgical patients, paralyzed persons, and newborns with respiratory distress syndrome also exhibit reduced mucociliary transport.

Chest physiotherapy has had a long history of clinical efficacy and is typically a part of standard medical regimens to enhance respiratory mucus transport. Chest physiotherapy can include mechanical manipulation of the chest, postural drainage with vibration, directed cough, active cycle of breathing and autogenic drainage. External manipulation of the chest and respiratory behavioral training are accepted practices as defined by the American Association for Respiratory Care Guidelines, 1991. The various methods of chest physiotherapy to enhance mucus clearance are frequently combined for optimal efficacy and are prescriptively individualized for each patient by the attending physician.

Cystic fibrosis (CF) is the most common inherited life-threatening genetic disease among Caucasians. The genetic defect disrupts chloride transfer in and out of cells, causing the normal mucus from the exocrine glands to become very thick and sticky, eventually blocking ducts of the glands in the pancreas, lungs and liver. Disruption of the pancreatic glands prevents secretion of important digestive enzymes and causes intestinal problems that can lead to malnutrition. In addition, the thick mucus accumulates in the lung's respiratory tracts, causing chronic infections, scarring, and decreased vital capacity. Normal coughing is not sufficient to dislodge these mucus deposits. CF usually appears during the first 10 years of life, often in infancy. Until recently, children with CF were not expected to live into their teens. However, with advances in digestive enzyme supplementation, anti-inflammatory therapy, chest physical therapy, and antibiotics, the median life expectancy has increase to 30 years with some patients living into their 50's and beyond. CF is inherited through a recessive gene, meaning that if both parents carry the gene, there is a 25 percent chance that an offspring will have the disease, a 50 percent chance they will be a carrier and a 25 percent chance they will be genetically unaffected. Some individuals who inherit mutated genes from both parents do not develop the disease. The normal progression of CF includes gastrointestinal problems, failure to thrive, repeated and multiple lung infections, and death due to respiratory insufficiency. While some patients experience grave gastrointestinal symptoms, the majority of CF patients (90 percent) ultimately succumb to respiratory problems.

A demanding daily regimen is required to maintain the CF patient's health, even when the patient is not experiencing acute problems. A CF patient's CF daily treatments may include:

- Respiratory therapy to loosen and mobilize mucus;
- Inhalation therapy with anti-inflammatory drugs, bronchodilators and antibiotics for infections;
- Oral and intravenous antibiotics to control infection;
- Doses of Pulmozyme to thin respiratory mucus;
- 20 to 30 pancreatic enzyme pills taken with every meal to aid digestion;
- a low-fat, high-protein diet;
- Vitamins and nutritional supplements; and
- Exercise.

A lung transplant may be the only hope for patients with end stage cystic fibrosis.

Virtually all patients with CF require respiratory therapy as a daily part of their care regimen. The buildup of thick, sticky mucus in the lungs clogs airways and traps bacteria, providing an ideal environment for respiratory infections and chronic inflammation. This inflammation causes permanent scarring of the lung tissue, reducing the capacity of the lungs to absorb oxygen and, ultimately, sustain life. Respiratory therapy must be performed, even when the patient is feeling well, to prevent infections and maintain vital capacity. Traditionally, care providers perform Chest Physical Therapy (CPT) one to four times per day. CPT consists of a patient lying in one of twelve positions while a caregiver "claps" or pounds on the chest and back over each lobe of the lung. To treat all areas of the lung in all twelve positions requires pounding for half to three-quarters of an hour along with inhalation therapy. CPT clears the mucus by shaking loose airway secretions through chest percussions and draining the loosened mucus toward the mouth. Active coughing is required to ultimately remove the loosened mucus. CPT requires the assistance of a caregiver, often a family member but a nurse or respiratory therapist if one is not available. It is a physically exhausting process for both the CF patient and the caregiver. Patient and caregiver non-compliance with prescribed protocols is a well-recognized problem that renders this method ineffective. CPT effectiveness is also highly technique sensitive and degrades as the giver becomes tired. The requirement that a second person be available to perform the therapy severely limits the independence of the CF patient.

Artificial respiration devices for applying and relieving pressure on the chest of a person have been used to assist in lung breathing functions, and loosening and eliminating mucus from the lungs of CF persons. Subjecting the person's chest and lungs to pressure pulses or vibrations decreases the viscosity of lung and air passage mucus, thereby enhancing fluid mobility and removal from the lungs. These devices use vests having air-accommodating bladders that surround the chests of persons. Mechanical mechanisms, such as solenoid or motor-operated air valves, bellows and pistons are disclosed in the prior art to supply air under pressure to diaphragms and bladders in regular pattern or pulses. The bladder worn around the thorax of the CF person repeatedly compresses and releases the thorax at frequencies as high as 25 cycles per second. Each compression produces a rush of air through the lobes of the lungs that shears the secretions from the sides of the airways and propels them toward the mouth where they can be removed by normal coughing. External chest manipulation with high frequency chest wall oscillation was reported in 1966. *Beck GJ. Chronic Bronchial Asthma and Emphysema. Rehabilitation and Use of Thoracic Vibrocompression, Geriatrics* (1966), 21: 139–158.

G. A. Williams in U.S. Pat. No. 1,898,652 discloses an air pulsator for stimulating blood circulation and treatment of tissues and muscles beneath the skin. A reciprocating piston is used to generate air pressure pulses which are transferred through a hose to an applicator having a flexible diaphragm. The pulsating air generated by the moving piston imparts relatively rapid movement to the diaphragm which subjects the person's body to pulsing forces.

J. D. Ackerman et al in U.S. Pat. No. 2,588,192 disclose an artificial respiration apparatus having a chest vest supplied with air under pressure with an air pump. Solenoid-operated valves control the flow of air into and out of the vest in a controlled manner to pulsate the vest, thereby subjecting the person's chest to repeated pressure pulses.

J. H. Emerson in U.S. Pat. No. 2,918,917 discloses an apparatus for exercising and massaging the airway and associated organs and loosening and removing mucus therefrom. A blower driven with a motor creates air pressure for a device that fits over a person's nose and mouth. A diaphragm reciprocated with an electric motor pulses the air flowing to the device and the person's airway. The speed of the motor is controlled to regulate the number of vibrations per minute.

R. F. Gray in U.S. Pat. No. 3,078,842 discloses a bladder for cyclically applying an external pressure to the chest of a person. A pressure alternator applies air pressure to the bladder. A pulse generator applies air pressure to the bladder to apply pressure pulses to the chest of the person.

R. S. Dillion in U.S. Pat. No. 4,590,925 uses an inflatable enclosure to cover a portion of a person's extremity, such as an arm or leg. The enclosure is connected to a fluid control and pulse monitor operable to selectively apply and remove pressure on the person's extremity.

W. J. Warwick and L. G. Hansen in U.S. Pat. Nos. 4,838,263 and 5,056,505 disclose a chest compression apparatus having a chest vest surrounding a person's chest. A motor-driven rotary valve allows air to flow into the vest and vent air therefrom to apply pressurized pulses to the person's chest. An alternative pulse pumping system has a pair of bellows connected to a crankshaft with rods operated with a dc electric motor. The speed of the motor is regulated with a controller to control the frequency of the pressure pulses applied to the vest. The patient controls the pressure of the air in the vest by opening and closing the end of an air vent tube.

C. N. Hansen in U.S. Pat. Nos. 5,453,081 and 5,569,170 discloses an air pulsating apparatus for supplying pulses of air to an enclosed receiver, such as a vest located around a person's chest. The apparatus has a casing with an internal chamber containing a diaphragm. An electric operated device, such as a solenoid, connected to the diaphragm is operated with a pulse generator to vibrate the diaphragm to pulse the air in the chamber. A hose connects the chamber with the vest to transfer air and air pulses to the vest which applies pressure pulses to the person's chest.

N. P. Van Brunt and D. J. Gagne in U.S. Pat. Nos. 5,769,797 and 6,036,662 disclose an oscillatory chest compression device having a wall with an air chamber and a diaphragm mounted on the wall and exposed to the air chamber. A rod pivotally connected to the diaphragm and rotatably connected to a crankshaft transmits force to the diaphragm during rotation of the crankshaft. An electric motor drives the crankshaft at selected controlled speeds to regulate the frequency of the air pulses generated by the moving diaphragm. An air flow generator, shown as a blower, delivers air to the air chamber to maintain the pressure of the air in the chamber. Controls for the motors that move the diaphragm and blower are responsive to the pressure of the air in the air chamber. These controls have air pressure responsive feedback systems that regulate the operating speeds of the motors to control the pulse frequency and air pressure in the vest.

SUMMARY OF THE INVENTION

The invention comprises a vest used to apply repetitive pressure pulses to a human body. The vest is connected to a pulsator for generating air pressure and air pulses that are transmitted to the vest. The vest has a non-elastic shell comprising an outer cover attached to a flexible liner. The cover and liner surround an internal pocket. An air core of flexible material located in the pocket between the cover and liner is connected with a hose to an air pulsator operable to generate air pressure and air pressure pulses which are transmitted to the air core and liner. The air pressure inflates the air core. The air pressure pulses subjected to the inflated air core create repetitive pressure pulses that are transmitted to the body of a person Wearing the vest to enhance airway clearance of the person's respiratory system. The vest has a non-elastic outer cover located over a flexible inside liner. The adjacent peripheral edges of the top and sides of the cover and liner are secured together and surround the internal pocket. A closure member, such as a zipper, attached to the cover and liner allows an air core to be placed in the internal pocket. The non-elastic cover is fabric or plastic sheet material. The liner is an elastic flexible fabric or plastic adapted to surround a person's chest and transmit pressure pulses to the chest of the person's body.

The vest has left and right front chest panels joined to a back section. Shoulder straps joined to the back section extended over the shoulders of a person are attached with first releasable fasteners, such as cooperating hook and loop fasteners, to the front panels of the vest. The front chest panels have over lapping end flaps having cooperating second releasable fasteners, such as hook and loop fasteners, that hold the vest in a firm fit around the thorax of the person. An additional releasable vest retainer connected to the end flaps are used to prevent the first releasable fasteners from disengaging from the end flaps during the application of repetitive pressure pulses to the body of the person. The releasable vest retainer is an elongated strap secured to one end flap and at least one ring secured to the other end flap. The strap extends through the ring and releasably attaches to itself with releasable hook and loop fasteners. The strap can be quickly released by pulling on the free end of the strap to allow the vest to be removed from the body of the person.

The air core located in the pocket has flexible walls surrounding an air chamber. Vertical seals in the air core adjacent the underarms of the person's body prevent bulging of the air chamber between the arms and sides of the body of the person. A plurality of small apertures in the air core adjacent the vertical seals allows air to ventilate from the air chamber and deflate the air core. The apertures are located in laterally spaced vertical rows in the side walls of the air core. Horizontal divider seals in the bottom of the air core provide a sleeve along the bottom of the air core. The horizontal divide seals are spaced from each other providing a plurality of openings to allow air to flow from the air passage in the sleeve into the air chamber. Spacer pads located between the seals ensure upward air flow from the air passage into the air chamber. The pulsing of air in the air chamber applies inward and upward pressure pulses to the thorax of the person to facilitate airway clearance of secretions. A flexible wire coil located in the sleeve holds the sleeve in a tubular shape and maintains the air passage in the sleeve open to allow air to flow along the length of the air passage. The coil and non-elastic cover extended around the inside of the sleeve limits inward pressure of the sleeve on the abdomen of the person. The coil is attached to a collar which extends through openings in the lower end of the air core and cover. The collar has an open end to allow the air pulsator to be connected to the collar with an elongated hose to supply air pressure and air pressure pulses to the air in the air passage in the sleeve an air chamber of the air core.

DESCRIPTION OF PREFERRED EMBODIMENT

Figure 1:
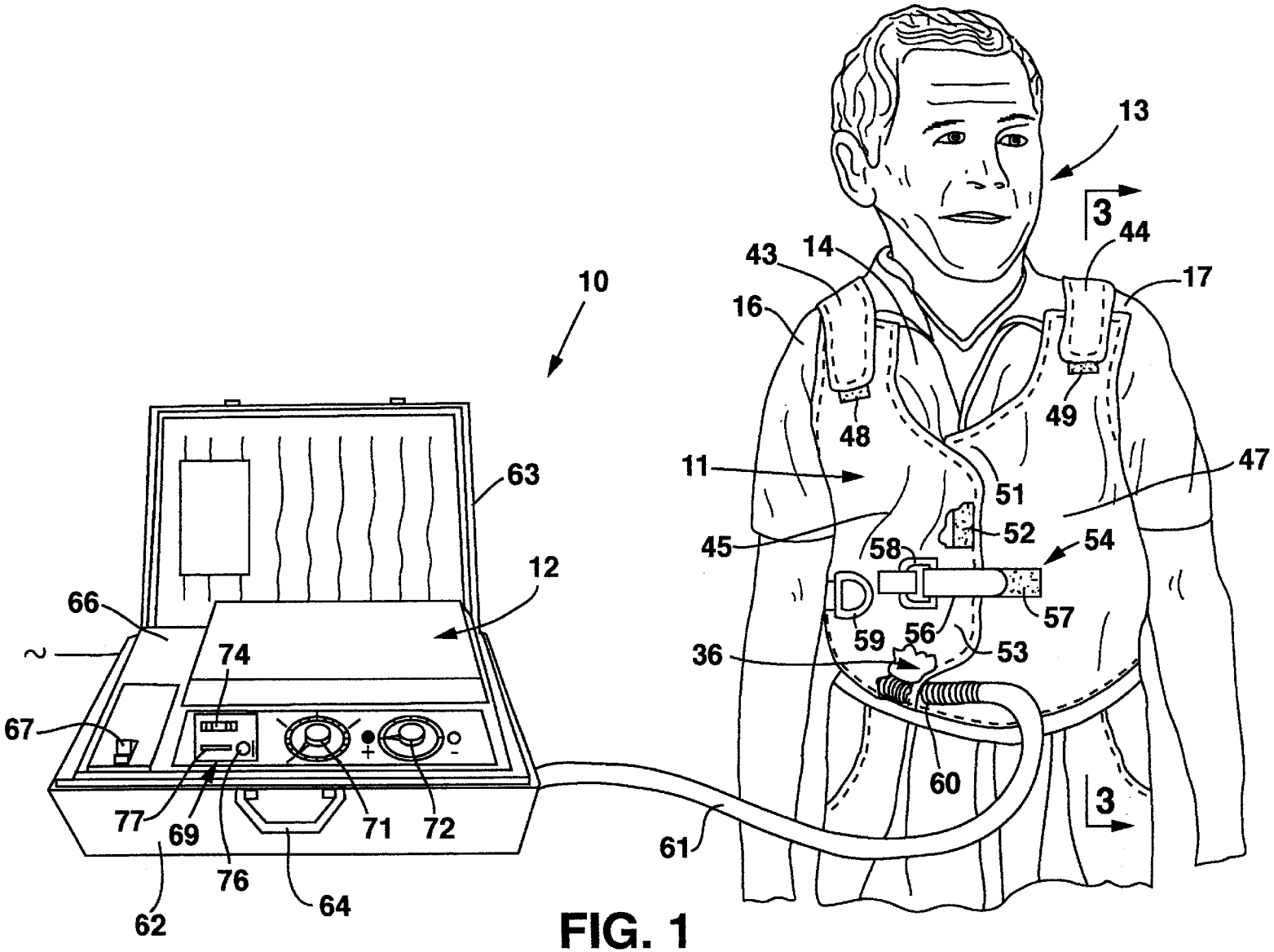
FIG. 1 is a diagrammatic view of an air pressure and pulse generator coupled to an air core located in a vest located around the chest of a person.

The body pulsating apparatus, indicated generally at 10 in FIG. 1, has a vest 11 and an air pressure and pulse generator 12 operable to apply repetitive pressure pulses to the vest located about a human body to provide secretion and mucus clearance therapy. Respiratory mucus clearance is applicable to many medical conditions, such as pertussis, cystic fibrosis, atelectasis, bronchiectasis, cavitating lung disease, vitamin A deficiency, chronic obstructive pulmonary disease, asthma, and immobile cilia syndrome. Post surgical patients, paralyzed persons, and newborns with respiratory distress syndrome have reduced mucociliary transport. Apparatus 10 provides high frequency chest wall oscillations or pulses to enhance mucus clearance in a person 13 with reduced mucociliary transport.

Figure 2:
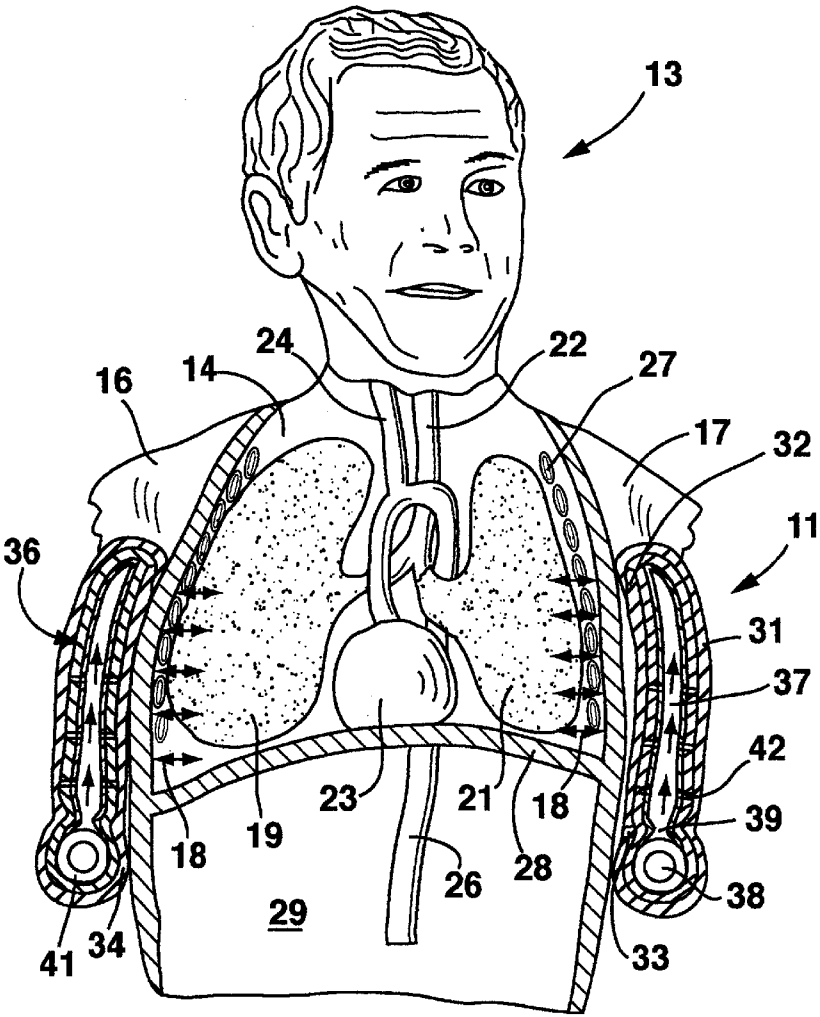
FIG. 2 is a diagrammatic view, partly sectioned, of the air core, vest, and person of FIG. 1.

Vest 11 located around the person's upper body or thorax 14 is supported on the person's shoulders 16 and 17. As shown in FIG. 2, vest 11 expanded into substantial surface contact with the exterior of upper body 14 functions to apply repeated compression or pressure pulses, shown by arrows 18 to body 14. The reaction of body 14 to the pressure pulses causes repetitive expansion of the body when the pressure pulses are in the low pressure phase of the pressure cycle. The pressure pulses subjected to lungs 19 and 21 and trachea 22 provide secretions and mucus clearance therapy. The thoracic cavity occupies only the upper part of the thoracic cage and contains right and left lungs 19 and 21, heart 23, arteries 24 and 26, and rib cage 27. The repeated pressure pulses applied to thorax 14 stimulates heart 23 and blood flow in arteries 24 and 26 and veins in the chest cavity. Muscular and nerve tensions are also relieved by the repetitive pressure pulses imparted to the front, sides, and back portions of thorax 14. The lower part of the thoracic cage comprises the abdominal cavity 29 which reaches upward as high as the lower tip of the sternum so as to afford considerable protection to the large and easily injured abdominal organs, such as the liver, spleen, stomach, and kidneys. The two cavities are separated by a dome-shaped diaphragm 28. Rib cage 27 has twelve ribs on each side of the trunk. The ribs consist of a series of thin, curved, rather elastic bones which articulate posteriorly with the thoracic vertebrae. The spaces between successive ribs are bridged by intercostal muscles. The rib cage 29 aids in the distribution of the pressure pulses to the lungs 19 and 21 and trachea 22.

Vest 11 has an outside cover 31 comprising a non-elastic material, such as a nylon fabric. Other types of materials can be used for cover 31. Cover 31 is secured to a flexible inside liner 32 located adjacent and around body 14. Liner 32 is a flexible fabric, such as a porous cotton fabric, that allows air to flow through the fabric toward body 14. A closure device 33, shown as a zipper, secures the bottom of liner 32 to an upwardly directed end portion 34 of cover 31. An air core or bladder 36 having internal air chamber 37 and an air receiving passage 38 is located between cover 31 and liner 32. A plurality of airways or passages 39 between passage 38 and chamber 37 allow air to flow upwardly into chamber 37. An elongated coil spring 41 in the lower portion of air core 36 inside passage 38 maintains the passage 38 open. Other types of structures that maintain manifold passage 38 open and allow air to flow through passage 38 can be used in the lower portion of air core 36. The inside end portion 33 of non-elastic cover 31 and coil spring 41 substantially reduces the inward pressure of the vest on the abdominal cavity 29 and organs therein and reduces stress on the digestive system. Air core 36 has a plurality of vertically aligned air flow control apertures 42 that restrict the flow of air from air core chamber 37 into the space between cover 31 and liner 32. The air flowing through porous liner 32 ventilates and cools body 14 surrounded by vest 11.

Returning to FIG. 1, vest 11 has a pair of upright shoulder straps 43 and 44 laterally separated with a concave upper back edge. Upright front chest portions 45 and 47 are separated from straps 43 and 44 with concave curved upper edges which allow vest 11 to fit under the person's arms. Releasable fasteners, such as loop pads 48 and 49, secured to the outer surfaces of chest portions 45 and 47 cooperate with hook pads (not shown) secured to the insides of shoulder straps 43 and 44 to releasably connect shoulder straps 43 and 44 to chest portions 45 and 47. Shoulder straps 43 and 44 extend forwardly over shoulders 16 and 17 and downwardly over chest portions 45 and 47. The hook and lop pads are releasable VELCRO fasteners that connect shoulder straps 43 and 44 to chest portions 45 and 47 and hold chest portions 46 and 47 adjacent the front of body 14.

Vest 11 has a first lateral end flap 51 extended outwardly at the left side of the vest. A rectangular loop pad 52 secured to the outside of the end flap 51 cooperates with hook pads 50 on a second lateral end flap 53 on the right side of vest 11 to hold vest 11 around body 14. The hook and loop pads 50 and 52 are VELCRO fasteners that allow vest 11 to be firmly wrapped around body 14.

As shown in FIG. 1, a releasable retainer 54 connected to the vest end flaps hold the flaps 51 and 53 in over lapped positions and prevents the releasable hook and loop fasteners 52 from disengaging during the application of repetitive pulse to the body 14 on the person 13. Retainer 54 comprises an elongated strap 56 secured at one end thereof to chest portion 53. Opposite ends of strap 56 have hook and loop releasable fasteners 57 that allow strap 56 to be fastened into a D-ring. A D-ring 58 attached to chest portion 45 is aligned with strap 56. Strap 56 is looped through D-ring 58 and connected with fasteners 57 to hold the vest end flaps 51 and 53 and vest 11 around the body 14 of the person. The free end of strap 56 can be quickly pulled to release fasteners 57 and disengage retainer 54.

Figure 4:
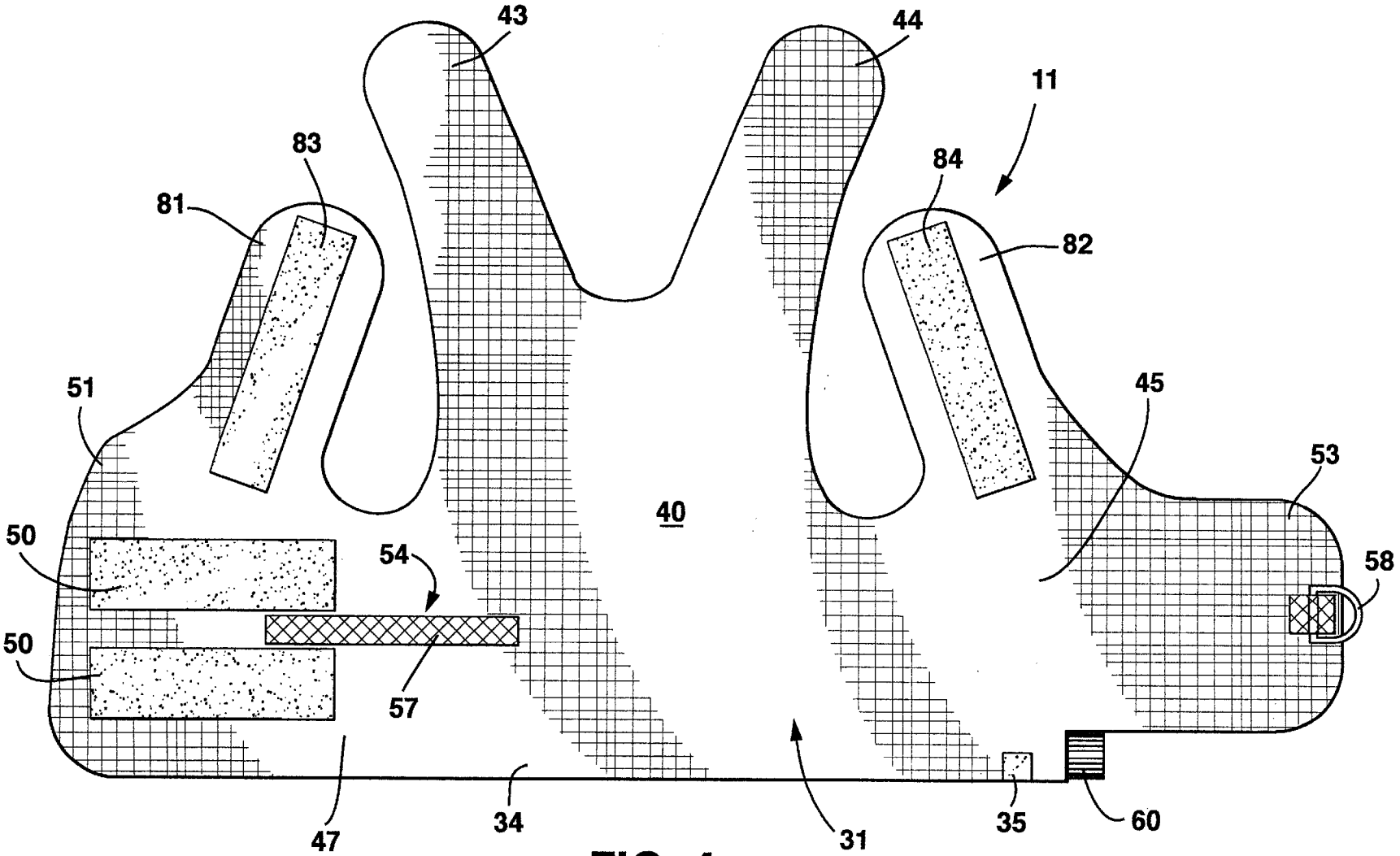
FIG. 4 is an outside plan view of the vest of FIG. 1 in a planar position.
Figure 5:
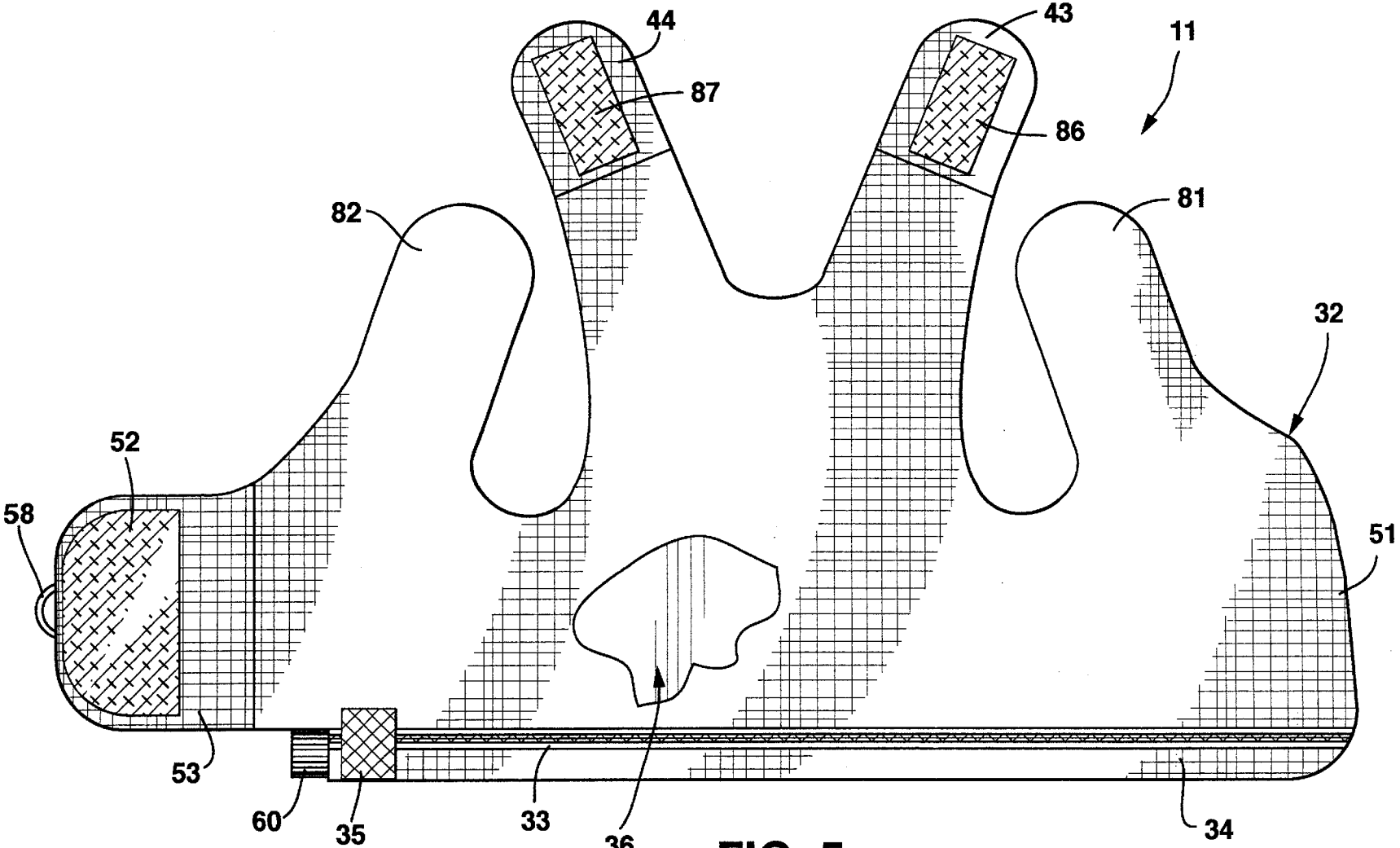
FIG. 5 is an inside plan view of the vest of FIG. 4.
Figure 6:
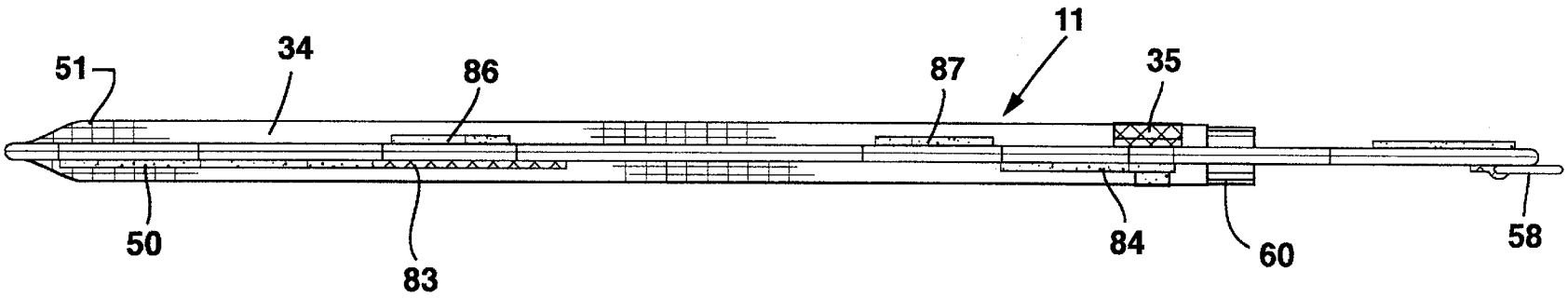
FIG. 6 is a top plan view of the vest of FIG. 4.
Figure 7:
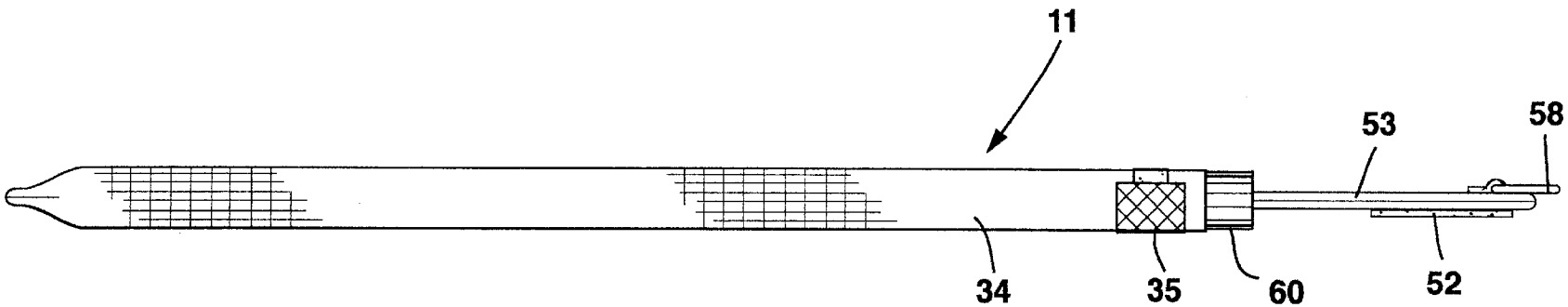
FIG. 7 is a bottom plan view of the vest of FIG. 4.
Figure 9:
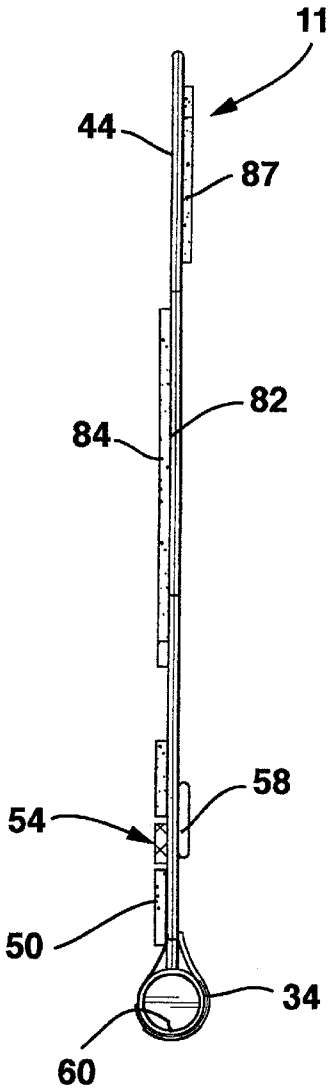
FIG. 9 is a side elevational view of the right side of FIG. 4.
Figure 8:
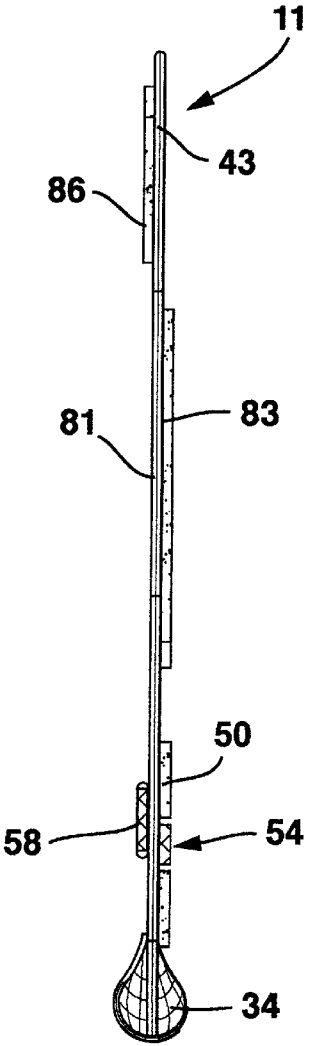
FIG. 8 is a side elevational view of the left side of FIG. 4.

As shown in FIGS. 4 and 5, vest 11 has a non-elastic fabric cover 31 having a back section 40 joined to upwardly directed shoulder straps 43 and 44. The bottom of cover 31 has a lower upwardly turned end 34 secured to a closure device 33, such as a conventional linear zipper, which can be opened to allow access into the vest. A flap 35 secured to cover 31 extends over the zipper tab to prevent the tab from being pressed into the person's body. End 34 is a non-elastic fabric which limits inward or compression forces on the abdomen of the person. A flexible fabric liner 32 is secured to the outer edges of cover 31 and closure device 33. Front panels 45 and 47 joined to opposite sides of back section 40 extend around the thorax and are releasably connected with loop and hook fasteners 50 and 52, such as VELCRO fasteners. A secondary releasable connector 54 having an elongated strap 56 secured to panel 47 and a D-ring 58 secured to panel 45 are used as an additional structure for holding panels 45 and 47 in overlapped positions. Strap 56 has hook and loop pads 57 that releasable connect end portions of strap 56. Front panels 45 and 47 are joined to upwardly directed front straps 81 and 82. Elongated loop fastener pads 83 and 84 secured to front straps 81 and 82 extend the length thereof. As shown in FIG. 5, shoulder straps 43 and 44 have hook pads 86 and 87 secured to the outer end portions thereof. Hook pads 86 and 87 cooperate with loop pads 83 and 84 to support vest 11 on the shoulders of person 13.

Figure 10:
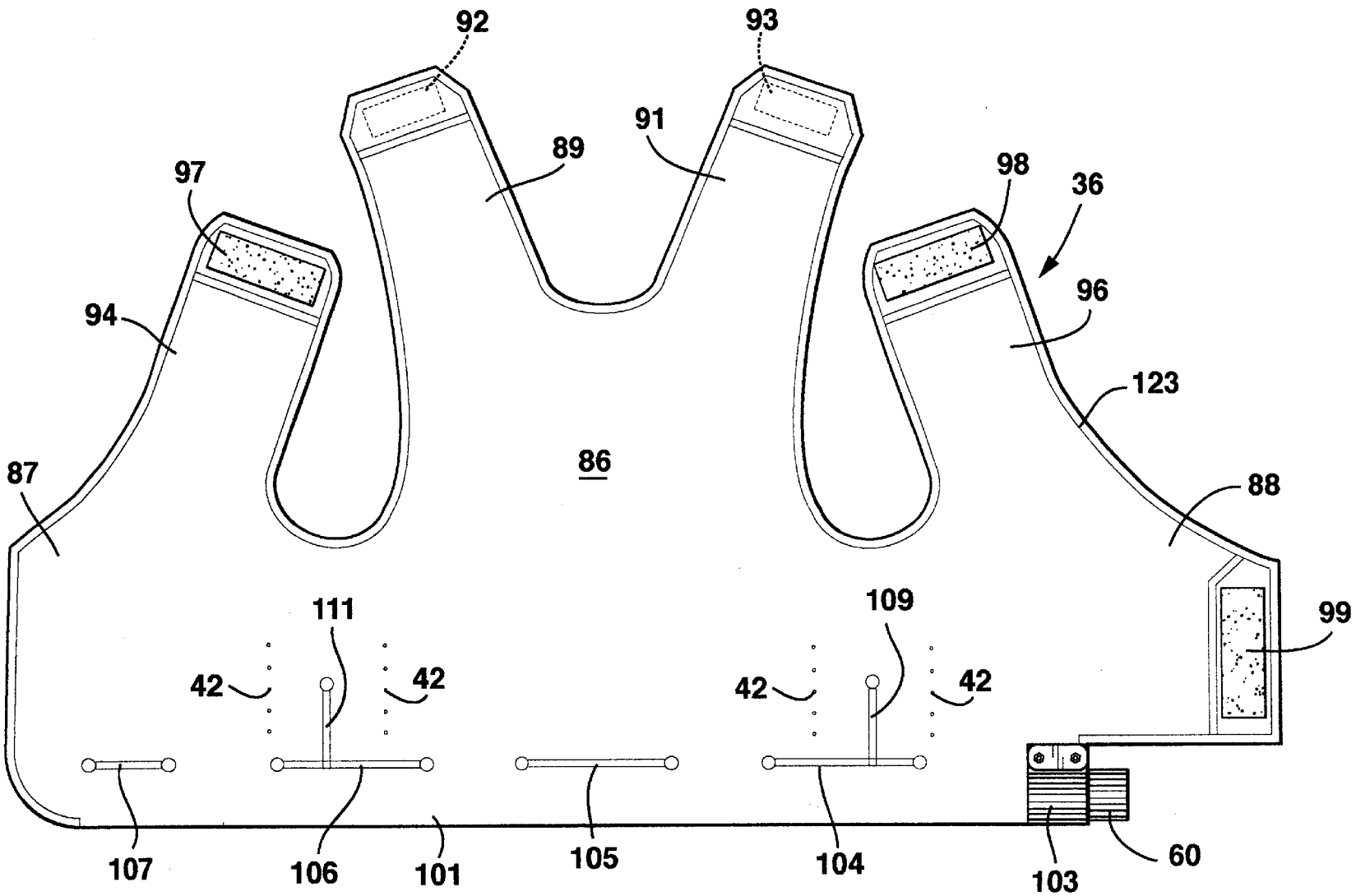
FIG. 10 is a front elevational view of the air core separated from the vest of FIG. 4.
Figure 11:
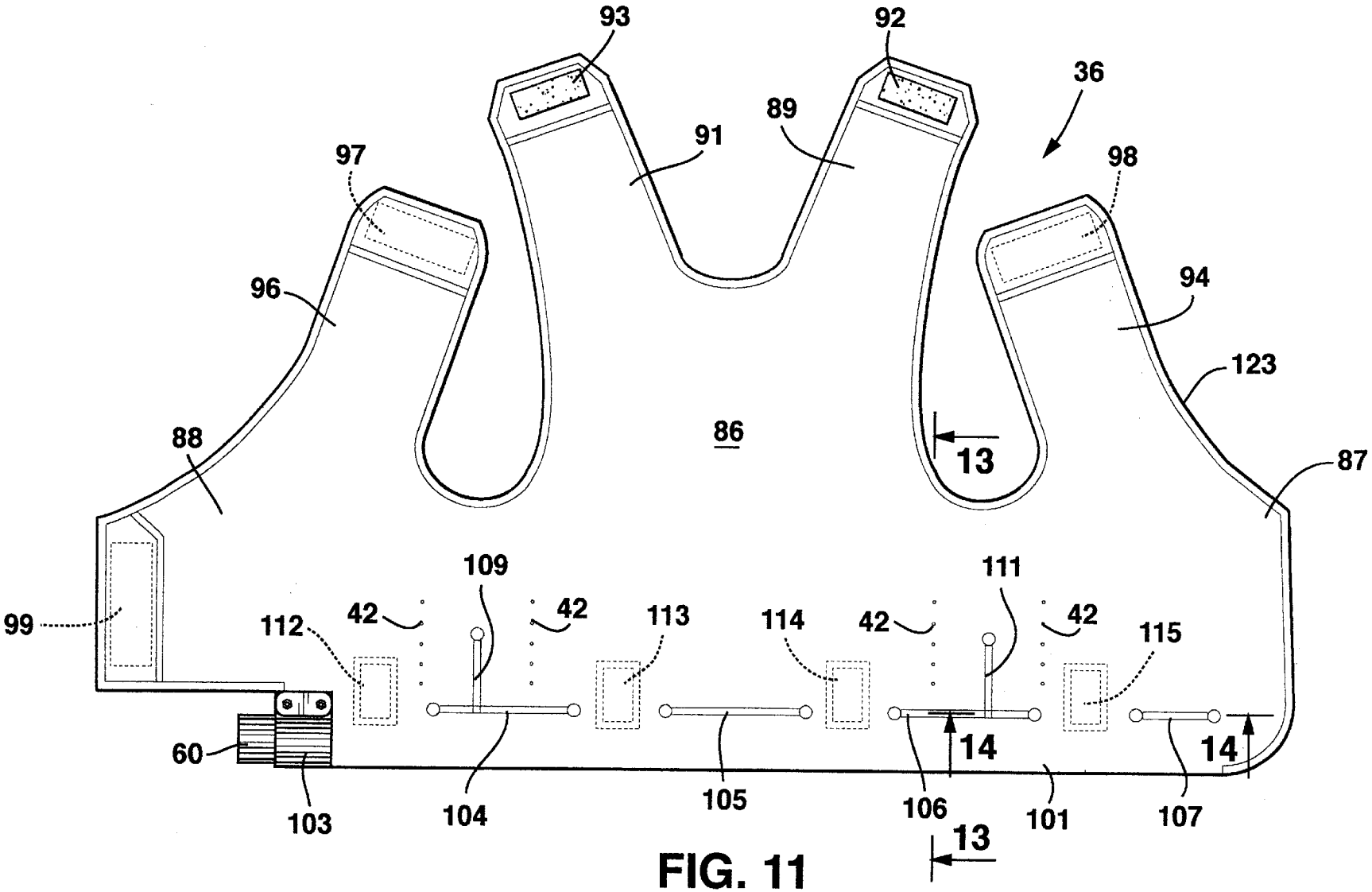
FIG. 11 is a rear elevational view of the air core of FIG. 10.
Figure 12:
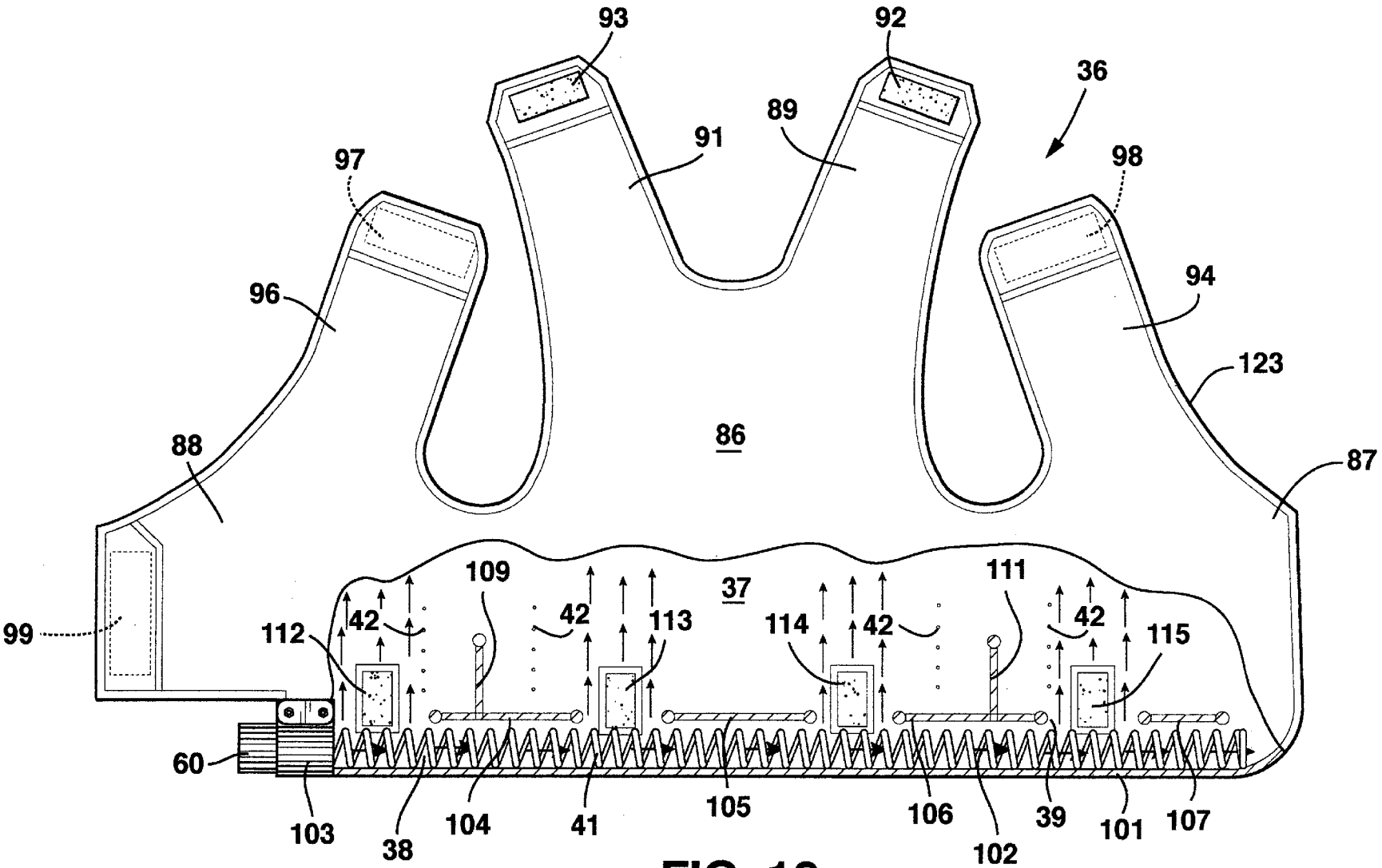
FIG. 12 is an elevational view similar to FIG. 11, partly sectioned to show the air flow in the air core.

Air core 36 adapted to be located within vest 11, shown in FIGS. 10, 11 and 12, has a back section 86 joined to front panel sections 87 and 88 surrounding internal air chamber 37. Upwardly directed shoulder sections 89 and 91 are joined to back section 86. The upper ends of sections 89 and 91 have loop pads 92 and 93. Panel sections 87 and 88 have upwardly directed front sections 94 and 96 having loop pads 97 and 98. A loop pad 99 is secured to the outer end of panel section 88. Loop pads 92, 93, 97, 98 and 99 cooperate with hook pads secured to the inside of vest 11 to hold air core 36 within shoulder straps 43 and 44, front straps 81 and 82, and front panels 45 and 47. Other types of holding structures can be used to retain the location of air core 36 within vest 11.

Figure 13:
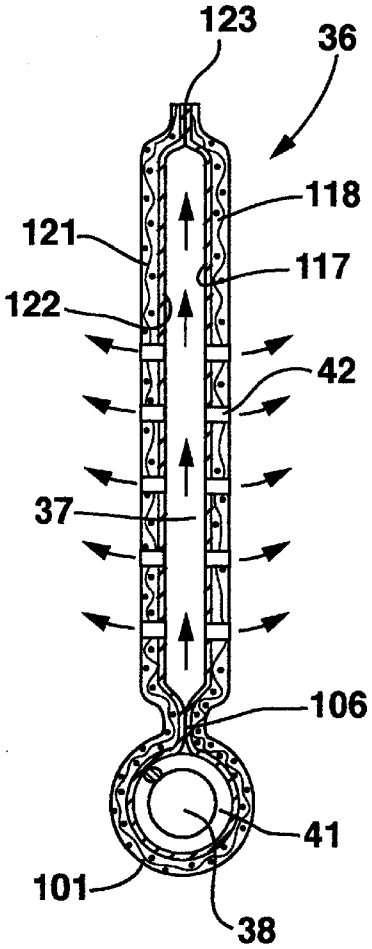
FIG. 13 is an enlarged sectional view taken along line 13—13 of FIG. 11.

As shown in FIG. 12, coil spring 41 extended along the bottom of air core 36 located in sleeve 101 surrounds an air receiving passage 38. Spring 41 is a flexible metal coil spring that allows the vest to be placed about the body of a person. Coil 41 maintains the lower portion or sleeve 101 of air core 36 in a tubular shape to ensure the flow of air in passage 38. Passage 38 extends between tube connector 60 and the opposite end of air core 36 to carry air and air pressure pulses, shown by arrows 102, along the length of passage 38. A tubular clamp 103 secures the air inlet end of spring 41 and tubular connector 60 to air core 36. A plurality of horizontal seals 104, 105, 106 and 107 in air core 36 extend along the top of spring 41. Adjacent seals are spaced from each other to provide passages 39 to allow air and air pressure pulses to flow upwardly into air chamber 37. The air pulses, shown by arrows 108, are also directed upwardly into air chamber 37. The air pulses direct inwardly and upwardly directed pressure forces to the thorax of person 13 to enhance airway clearance of secretions. Rows of air flow control apertures 42 in air core 36 extend upwardly from seals 104–107. Upright linear seals 109 and 111 separate the rows of apertures 42 extended upwardly from seals 104 and 106. As shown in FIG. 13, apertures 42 are small holes that allow air to escape from air chamber 37 and deflate air core 36. The rows of apertures 42 located between back section 86 and front sections 87 and 88 allow air to flow into vest 11 adjacent the opposite sides of the thorax of person 13. The flowing air cools the sides of the thorax surrounded by vest 11.

Figure 3:
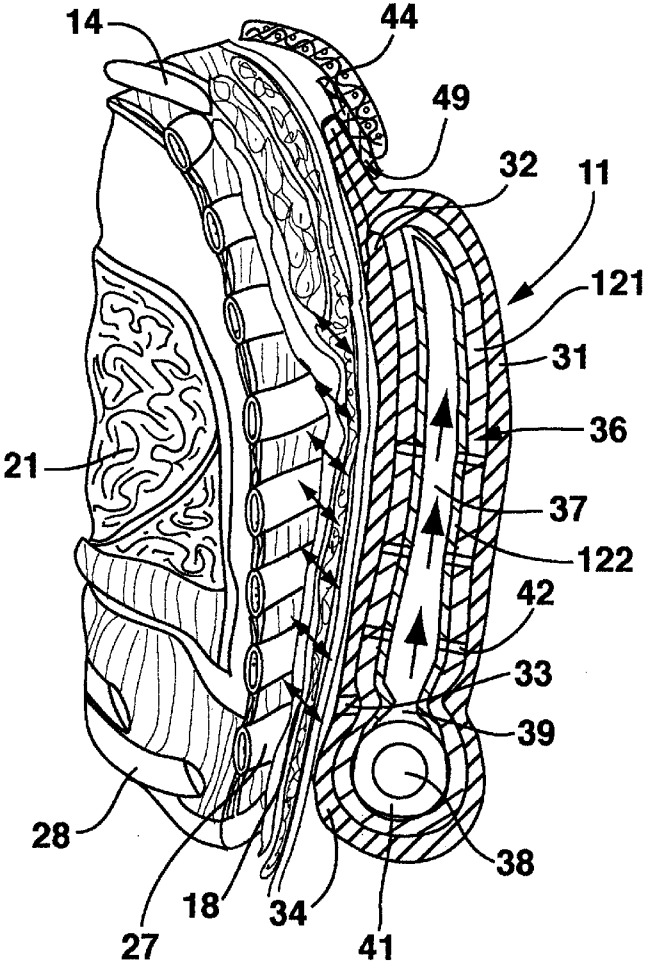
FIG. 3 is a sectional view taken along line 3—3 of FIG. 1.
Figure 14:
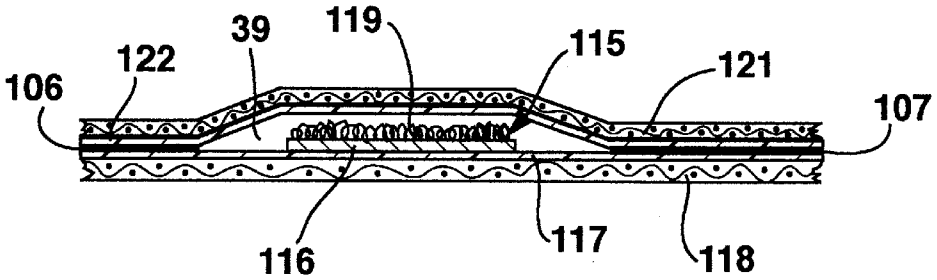
FIG. 14 is an enlarged sectional view taken along line 14—14 of FIG. 11.

As shown in FIG. 12, a spacer pad 112 is located adjacent the outer end of seal 104. Additional spacer pads 113, 114 and 115 are located between seals 104 and 105, 105 and 106, and 106 and 107. Spacer pads 112–115 maintain passages 39 open to ensure air flow and air pressure pulses from passage 38 into air chamber 37 of air core 36. Spacer pads 112–114 are rectangular loop pads secured with an adhesive to the inside wall of air core 36 between seals 104–107. As shown in FIG. 14, spacer pad 115 has a base 116 secured with an adhesive to the inside layer 117 of the first side wall 118 of air core 36. Loops 119 attached to base 116 project outwardly toward a second side wall 121 to space the inside layer 122 of side wall 121 providing passages 39 to allow air to flow from passage 38 into air chamber 37 of air core 36. Air also flows through loops 119 from passage 38 into air chamber 37. Side walls 118 and 121 are flexible sheets of plastic or fabric. The inside layers 117 and 122 are urethane plastic bonded o the inside of side walls 118 and 121. Layers 117 and 122 are air impervious except for the rows of apertures 42, shown in FIGS. 2, 3 and 13. The plastic of layers 117 and 122 are fused together along the length of seals 104–107. As shown in FIGS. 10 to 13, the adjacent outer peripheral edges of side walls 118 and 121 are fused together to prevent leakage of air from air core 36.

In use, vest 11 is placed about the person's body 14, as shown in FIGS. 1 and 2, and held in place with shoulder straps 43 and 44. Releasable fasteners 48 and 49 secure straps 43 and 44 to front panels 45 and 47. The circumferential location of vest 11 is maintained in a light fit around the person's body 14 with releasable fasteners 50 and 52. Retainer 54 maintains fasteners 50 and 52 in engagement with each other and prevents disengagement during the pulsating of vest 11. Strap 56 of retainer 54 is looped through D-ring 58 and attached together with hook and loop fasteners 57. Air pulsator 12 is then connected with hose 61 to collar 60. The operation of air pulsator 12 is started by turning switch 67 ON and setting timer 69 to the desired operating cycle. The rate of pulsation is controlled with control 71. The air flows from hose 61 into air passage 38 of sleeve 101 and openings 39 upwardly into air chamber 37 of air core 36. The pulsing of air in chamber 37 applies repetitive pressure pulses to the person's body. The operation of air pulsator 12 is described in U.S. Pat. No. 6,254,556 and U.S. patent application Ser. No. 60/218,128. The air pulsator of U.S. Pat. No. 6,254,556 is incorporated herein by reference. Other types of air pressure and air pulse generators can be used to provide air pressure and air pressure pulses to vest 11. Examples of air pressure and air pulse generators are disclosed in U.S. Pat. Nos. 1,898,652; 2,588,192; 2,918,917; 3,078,842; 4,838,263; 5,569,170 and 6,036,662.

Air pressure and pulse generator 12 is mounted in a case 62 having an open top and a cover 63 hinged to case 62 operable to close case 62. A handle 64 pivotally mounted on case 62 is used as a hand grip to facilitate transport of generator 12. Case 62 and cover 63 have overall dimensions that allow the case to be an aircraft carryon item.

Air pressure and pulse generator 12 has a top member 66 mounted on case 62 enclosing the operating elements of the pulsator. Top member 66 is not readily removable from case 62 to prohibit unauthorized adjustments and repairs of the operating components of the air pressure and pulse generator 12. Top member 67 supports a main electric power switch 67 and a front panel 68 having an operating timer 69, a pulse frequency control knob 71 and an air pressure control knob 73. Knobs 71 and 72 are manually rotated to adjust the frequency of the air pressure pulses and the air pressure in vest air core 36. Timer 69 has a numerical read out panel 74 displaying count down time in minutes and seconds of a treatment cycle. A control knob 76 is used to select a time of a treatment cycle of between 0 to 30 minutes. The selected time period is registered on panel 74. An ON and STOP switch 77 actuates timer 69 and the pulsator motor. Frequency control knob 71 and regulates a motor controller which controls the air pulse frequency from 5 to 25 cycles per second. The adjustment of the air pressure in air core 36 is controlled by turning knob 72. The air pressure in air core 36 is controlled between 0.1 and 1.0 psi.

The present disclosure is a preferred embodiment of the body pulsating vest. It is understood that the body pulsating vest is not to be limited to the specific materials, constructions and arrangements shown and described. It is understood that changes in parts, materials, arrangement and locations of structures may be made without departing from the invention.

What is claimed is:

1. A vest for applying repetitive pressure pulses to a human body comprising: a non-elastic outer cover, a flexible liner attached to the cover surrounding a pocket, an air core located in the pocket between the cover and liner adapted to accommodate air pressure pulses which apply pressure pulses to a human body wearing the vest, said air core having flexible side walls secured together providing an air chamber for accommodating air, said side walls having bottom portions, an elongated sleeve joined to the bottom portions of the side walls having an air receiving passage, said bottom portions having at least one passage open to said air chamber and air receiving passage to allow air and air pressure pulses to flow from the air receiving passage into said air chamber, and a flexible coil spring located within and extended along the length of the sleeve and the air receiving passage of said sleeve to maintain the air receiving passage open to allow air to flow in said air receiving passage.

2. The vest of claim 1 wherein: said bottom portions of the side walls have a plurality of spaced seals joining the side walls, the spaces between the seals being open to provide air flow passages open to said air chamber and air receiving passage to allow air and air pressure pulses to flow upwardly from the air receiving passage into said air chamber.

3. The vest of claim 2 including: spacer means secured to a side wall extended through said spaces between the seals to maintain said air flow passages open.

4. The vest of claim 3 wherein: said spacer means comprise loop pads secured to a side wall.

5. The vest of claim 1 including: apertures in said side walls to allow air to flow from the air chamber into the pocket between the cover and liner.

6. The vest of claim 5 including: an upright seal securing the side walls together located adjacent said apertures.

7. The vest of claim 1 including: upright rows of apertures in the side walls to allow air to flow from the air chamber into the pocket between the cover and the liner.

8. The vest of claim 7 including: upright seals securing the side walls together located between the upright rows of apertures.

9. The vest of claim 1 wherein: said bottom portions of the side walls have a plurality of horizontal spaced first seals and upright second seals joined to the first seals joining the side walls, the space between the first seals being open to provide air flow passages open to said air chamber and air receiving passage to allow air to flow upwardly from the air receiving passage into said air chamber, and apertures in said side walls adjacent said upright seals to allow air to flow out of the air chamber.

10. The vest of claim 9 including: spacer means secured to a side wall extended through said spaces between the seals to maintain said air flow passages open.

11. The vest of claim 10 wherein: said spacer means comprise loop pads secured to a side wall.

12. A vest for applying repetitive pressure pulses to a human body comprising: a non-elastic outer cover, a flexible liner attached to the cover surrounding a pocket, an air core located in the pocket between the cover and liner adapted to accommodate air pressure pulses which apply pressure pulses to a human body wearing the vest, said air core having flexible side walls secured together providing an air chamber for accommodating air, said side walls having bottom portions, an elongated sleeve joined to the bottom portions of the side walls having an air receiving passage, said bottom portions having at least one passage open to said air chamber and air receiving passage to allow air and air pressure pulses to flow from the air receiving passage into said air chamber, a flexible coil spring located within and extended along the length of the sleeve and the air receiving passage of said sleeve to allow air to flow in the air receiving passage, said cover having a pair of shoulder straps and chest portions, first releasable means connecting the shoulder straps to the chest portions, first and second end flaps joined to opposite ends of the cover, said end flaps being located in overlapping relation when the cover, liner, and air core are located around the body of the person, second releasable means connecting the first and second end flaps to hold the liner and air core in contact with the body of the person whereby when the air core is subjected to air pressure pulses repetitive pressure pulses are transmitted to the body of the person.

13. The vest of claim 11 wherein: said bottom portions of the side walls have a plurality of spaced seals joining the side walls, the spaces between the seals being open to provide air flow passages open to said air chamber and air receiving passage to allow air and air pressure pulses to flow upwardly from the air receiving passage into said air chamber.

14. The vest of claim 13 including: spacer means secured to a side wall extended through said spaces between the seals to maintain said air flow passages open.

15. The vest of claim 14 wherein: said spacer means comprise loop pads secured to a side wall.

16. The vest of claim 12 including: apertures in said side walls to allow air to flow from the air chamber into the pocket between the cover and liner.

17. The vest of claim 16 including: an upright seal securing the side walls together located adjacent said apertures.

18. The vest of claim 12 including: upright rows of apertures in the side walls to allow air to flow from the air chamber into the pocket between the cover and the liner.

19. The vest of claim 18 including: upright seals securing the side walls together located between the upright rows of apertures.

20. A vest for applying repetitive pressure pulses to a human body comprising: a non-elastic outer cover, a flexible liner attached to the cover surrounding a pocket, an air core located in the pocket between the cover and liner adapted to accommodate air pressure pulses which apply pressure pulses to a human body wearing the vest, said air core having flexible side walls secured together providing an air chamber for accommodating air, said side walls having bottom portions, an elongated sleeve joined to the bottom portions of the side walls having an air receiving passage, said bottom portions having at least one passage open to said air chamber and air receiving passage to allow air and air pressure pulses to flow from the air receiving passage into said air chamber, means located within and along the length of the air receiving passage of said sleeve to allow air to flow in the air receiving passage, said cover having a pair of shoulder straps and chest portions, first releasable means connecting the shoulder straps to the chest portions, first and second end flaps joined to opposite ends of the cover, said end flaps being located in overlapping relation when the cover, liner, and air core are located around the body of the person, second releasable means connecting the first and second end flaps to hold the liner and air core in contact with the body of the person whereby when the air core is subjected to air pressure pulses repetitive pressure pulses are transmitted to the body of the person, said bottom portions of the side walls have a plurality of horizontal spaced first seals and upright second seals joined to the first seals joining the side walls, the space between the first seals being open to provide air flow passages open to said air chamber and air receiving passage to allow air to flow upwardly from the air receiving passage into said air chamber, apertures in said side walls adjacent said upright seals to allow air to flow out of the air chamber, and spacer means comprising loop pads secured to a side wall extended through said spaces between the seals to maintain said air flow passages open.

21. An air core useable to apply repetitive pressure pulses to a human body comprising: flexible side walls secured together providing an air chamber for accommodating air, said side walls having bottom portions, an elongated sleeve joined to the bottom portions having at least one passage open to said air chamber and air receiving passage to allow air and air pressure pulses to flow from the air receiving passage into said air chamber, and a flexible coil spring located within and extended along the length of the sleeve and the air receiving passage of said sleeve to maintain the air receiving passage open to allow air to flow in said air receiving passage and from the air receiving passages into the air chamber.

22. An air core useable to apply repetitive pressure pulses to a human body comprising: flexible side walls secured together providing an air chamber for accommodating air, said side walls having bottom portions, an elongated sleeve joined to the bottom portions having at least one passage open to said air chamber and air receiving passage to allow air and air pressure pulses to flow from the air receiving passage into said air chamber, and means located within and along the length of the air receiving passage of said sleeve to maintain the air receiving passage open to allow air to flow in said air receiving passage and from the air receiving passages into the air chamber, said bottom portions of the side walls have a plurality of spaced seals joining the side walls, the spaces between the seals being open to provide air flow passages open to said air chamber and air receiving passage to allow air and air pressure pulses to flow upwardly from the air receiving passage into said air chamber, and spacer means comprising loop pads secured to a side wall extended through said spaces between the seals to maintain said air flow passages open.

23. The air core of claim 21 including: apertures in said side walls to allow air to flow from the air chamber into the pocket between the cover and liner.

24. The air core of claim 23 including: an upright seal securing the side walls together located adjacent said apertures.

25. The air core of claim 21 including: upright rows of apertures in the side walls to allow air to flow from the air chamber into the pocket between the cover and the liner.

26. The air core of claim 25 including: upright seals securing the side walls together located between the upright rows of apertures.

27. An air core useable to apply repetitive pressure pulses to a human body comprising: flexible side walls secured together providing an air chamber for accommodating air, said side walls having bottom portions, an elongated sleeve joined to the bottom portions having at least one passage open to said air chamber and air receiving passage to allow air and air pressure pulses to flow from the air receiving passage into said air chamber, and means located within and along the length of the air receiving passage of said sleeve to maintain the air receiving passage open to allow air to flow in said air receiving passage and from the air receiving passages into the air chamber, said bottom portions of the side walls have a plurality of horizontal spaced first seals and upright second seals joined to the first seals joining the side walls, the space between the first seals being open to provide air flow passages open to said air chamber and air receiving passage to allow air to flow upwardly from the air receiving passage into said air chamber, apertures in said side walls adjacent said upright seals to allow air to flow out of the air chamber, and spacer means comprising loop pads secured to a side wall extended through said spaces between the first seals to maintain said air flow passages open.

28. A vest for applying repetitive pressure pulses to a human body comprising: a non-elastic outer cover, a flexible liner attached to the cover surrounding a pocket, an air core located in the pocket between the cover and liner, said air core having a bottom portion and an air chamber to accommodated air pressure pulses which apply pressure pulses to a human body wearing the vest, an elongated sleeve joined to the bottom portion of the air core having an air receiving passage, said bottom portion having at least one passage open to the air chamber and air receiving passage to allow air and air pressure pulses to flow from the air receiving passage into said air chamber, coil means located within and along the length of the air receiving passage of the sleeve to maintain the circumferential shape of the sleeve and passage for receiving air open to allow air to flow in said air receiving passage, said cover having a pair of shoulder straps and chest portions, first releasable means connecting the shoulder straps to the chest portions, first and second end flaps joined to opposite ends of the cover, said end flaps being located in overlapping relation when the cover, liner, and air core are located around the body of the person, second releasable means connecting the first and second end flaps to hold the liner and air core in contact with the body of the person whereby when the air core is subjected to air pressure pulses repetitive pressure pulses are transmitted to the body of the person, and third releasable means connecting the first and second end flaps operable to prevent the second releasable means from releasing the first and second end flaps during the application of repetitive pressure pulses to a human body.

29. The vest of claim 28 wherein: the third releasable means comprises an elongated strap secured to one end flap, at least one ring means secured to the other end flap for accommodating the strap, and releasable connecting means associated with the strap operable to releasably retain the strap in connecting relation with the ring means.

30. The vest of claim 29 wherein: the third releasable connecting means comprises hook and loop members secured to separate portions of the strap.

31. The vest of claim 30 wherein: the second releasable means comprise hook and loop members secured to first and second end flaps.

32. The vest of claim 29 wherein: the third releasable means comprises a plurality of ring means secured to the other end flap, said strap selectively accommodating one of said ring means.

33. The vest of claim 28 wherein: the first releasable means comprises hook and loop members.

34. The vest of claim 28 wherein: the second releasable means comprises hook and loop members secured to the first and second end flaps.

* * * * *